US006461023B1

(12) United States Patent
McLoughlin et al.

(10) Patent No.: US 6,461,023 B1
(45) Date of Patent: Oct. 8, 2002

(54) FOCUSED FLOODLIGHT HAVING MULTI-SECTIONAL REFLECTOR SURFACE FOR UNIFORM ILLUMINATION

(76) Inventors: John E. McLoughlin, 26 Southern Blvd., Nesconset, NY (US) 11767; Neocles G. Athanasiades, 6 Maybeck Dr., East Setauket, NY (US) 11733; Kiam Meng Toh, 15 Sunflower Dr., Hauppague, NY (US) 11788

( * ) Notice: Subject to any disclaimer, the term of this patent is extended or adjusted under 35 U.S.C. 154(b) by 0 days.

(21) Appl. No.: 09/431,943

(22) Filed: Nov. 1, 1999

(51) Int. Cl.[7] ..... F21V 7/09

(52) U.S. Cl. ..... 362/297; 362/347; 362/348; 362/346

(58) Field of Search ..... 362/518, 269, 362/270, 277, 282, 285, 297, 310, 341, 346, 347, 348, 349

(56) References Cited

U.S. PATENT DOCUMENTS 4,293,901 A * 10/1981 Hernandez ..... 362/346
4,300,187 A 11/1981 Fletcher
4,420,800 A 12/1983 Van Horn
4,709,312 A * 11/1987 Heinisch et al. ..... 362/298
5,404,869 A 4/1995 Parkyn, Jr. et al.
5,938,317 A * 8/1999 Thornton ..... 362/290

* cited by examiner

*Primary Examiner*—Sandra O'Shea
*Assistant Examiner*—Ismael Negron
(74) *Attorney, Agent, or Firm*—Louise S. Heim

(57) ABSTRACT

A focused floodlight is designed to provide uniform illumination throughout an emergency scene including a work area and an action area. The floodlight includes a light line and a reflector specially configured so that half the light illuminates the work area and half the light illuminates the action area. The reflector has four sections, each of which is shaped to reflect impinging light rays in a desired direction. Each of the four sections comprises a multitude of minute, individually aimed reflector elements which are designed so that the flux increases progressively as distance from the floodlight increases.

11 Claims, 3 Drawing Sheets

FIG. 1
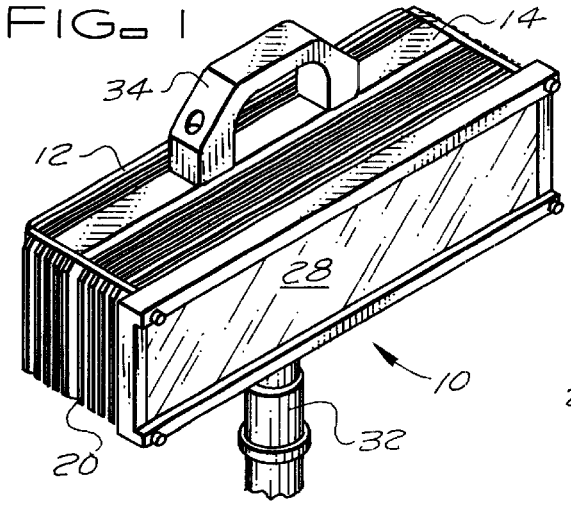
FIG. 2
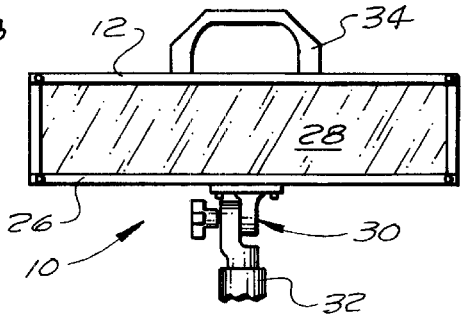
FIG. 3
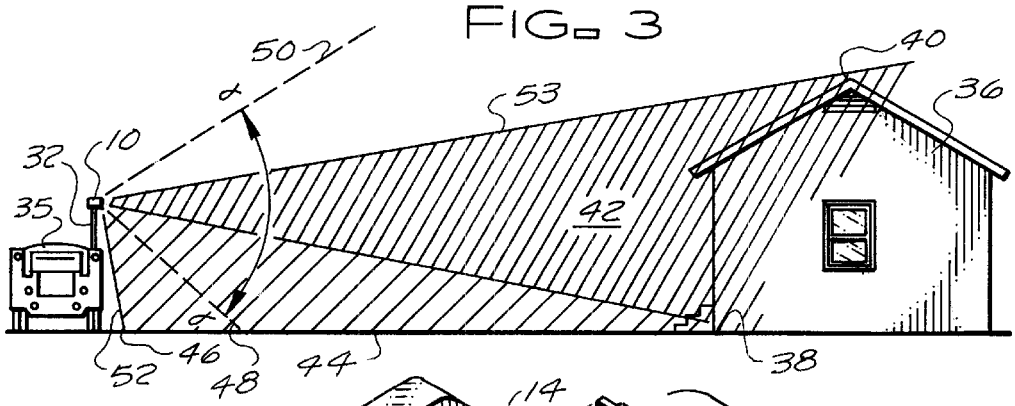
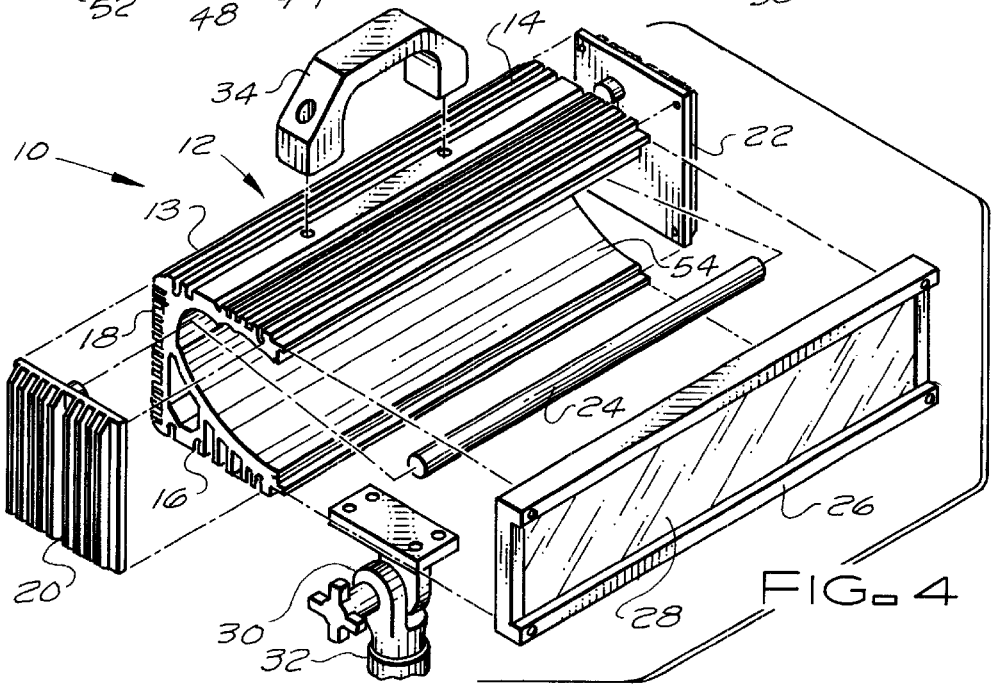
FIG. 4

FOCUSED FLOODLIGHT HAVING MULTI-SECTIONAL REFLECTOR SURFACE FOR UNIFORM ILLUMINATION

BACKGROUND

1. Field of the Invention

This invention relates to the art of lighting and illumination.

More particularly, this invention relates to a floodlight for illuminating an emergency scene.

In a further and more specific aspect, the invention concerns a focused floodlight having a reflector surface configured to emit progressively more light flux as the distance from the light line increases, resulting in generally uniform illumination over the entire emergency scene.

2. Description of the Prior Art

Emergency vehicles such as fire trucks are typically equipped with floodlights for illuminating an emergency scene. These floodlights are essentially the same as the types used for lighting sports stadiums, where the object is to emit light over a very large playing field, and to illuminate players located a long distance away from the lights themselves. Unfortunately, since the conditions of a typical emergency scene are very different from those of a typical sports stadium, the lighting produced by the conventional floodlights is not ideal for emergency purposes. For instance, the pattern of illumination produced by such floodlights has a spread of about 140°, which is simply too large for an emergency scene. Consequently, a significant amount of light simply shines into the sky, and is wasted. In addition, since most of the light is aimed a good distance away from the lamp itself, there is often insufficient lighting immediately alongside the emergency vehicle, where personnel keep their tools and prepare their gear. There exists a need, accordingly, for a new and improved floodlight which is customized for the conditions of a typical emergency scene, in order to provide generally uniform illumination over the relevant area.

SUMMARY OF THE INVENTION

Briefly, to achieve the desired objects of the instant invention in accordance with the preferred embodiments thereof, a floodlight is provided with a straight light line and an improved reflector configuration which emits progressively more light flux as the distance from the light increases, resulting in generally uniform illumination over an entire emergency scene comprising a structure approximately 30 feet high and an emergency vehicle located approximately 60 feet away from the structure. More specifically, the reflector is configured such that approximately half of the light is directed on to the portion of the emergency scene known as the "action area", defined as the conical section extending between the floodlight, the top of the structure, and the bottom of the structure. The other half of the light is directed to the portion known as the "work area", defined as the rectangular section extending between the bottom of the structure and a line parallel to the bottom of the structure passing almost directly under the floodlight.

For purposes of description, the reflector may be roughly divided into four sections. A first, generally parabolic section is located beneath the light line and configured to reflect rays from the light line in a path about ±5°–10° from horizontal to illuminate the action area of the emergency scene. A second section, also generally parabolic, is located behind the light line and configured to reflect rays of light from the light line in a direction less than 45° from horizontal to illuminate a front portion of the work area near the bottom of the structure. A third, generally arcuate, section is located above the light line and configured to reflect rays from the light line toward the first section wherein the rays are again reflected in a generally horizontal direction to illuminate the action area. A fourth, generally straight, section located above and forward of the light line is configured to reflect rays from the light line in a generally downward direction to illuminate a rear portion of the work area extending from almost directly below the floodlight to almost the bottom of the structure. Each of the sections comprises a multitude of individually aimed reflecting elements, each of which has been designed, using complex computer-aided design techniques, to produce the desired uniform distribution of light.

The first section itself is divided into two portions, including a front portion wherein each of the individually aimed reflecting elements is generally arcuate and a rear portion wherein the individually aimed reflecting elements comprise an alternating series of generally arcuate and generally flat elements. The individually aimed reflecting elements of the second section comprise a series of connected curved and flat elements. The individually aimed reflecting elements of the third section also comprise a series of connected curved and flat elements. The individually aimed reflecting elements of the fourth section comprise a series of connected curved elements.

BRIEF DESCRIPTION OF THE DRAWINGS

The foregoing and further and more specific objects and advantages of the instant invention will become readily apparent to those skilled in the art from the following detailed description of the preferred embodiment thereof taken in conjunction with the drawings in which:

FIG. 1 is a perspective view showing the floodlight of the instant invention;

FIG. 2 is a front view of the floodlight shown in FIG. 1;

FIG. 3 shows the floodlight being used to illuminate an emergency scene;

FIG. 4 is a perspective view showing the elements of the floodlight of FIG. 1 in exploded relationship to one another;

DETAILED DESCRIPTION OF THE PREFERRED EMBODIMENT

Figure 5:
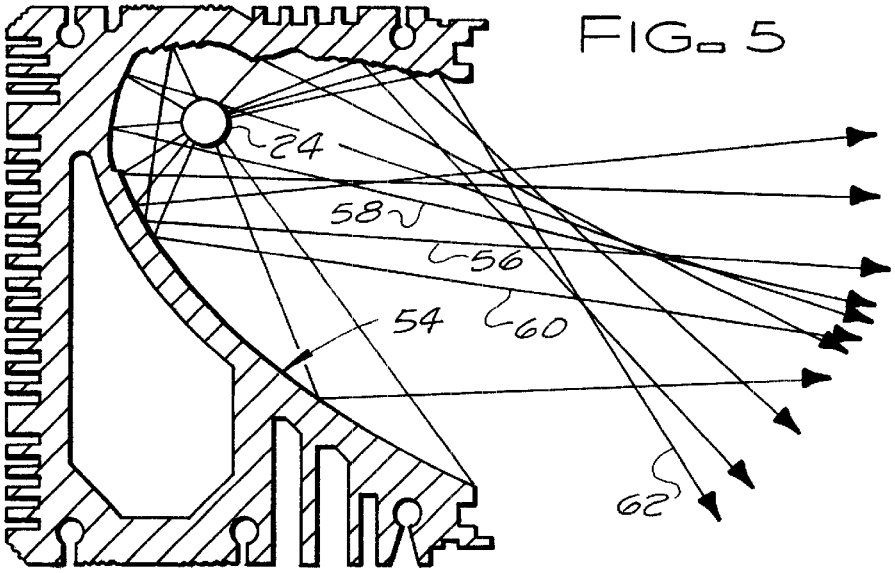
FIG. 5 is a sectional view of the floodlight of FIG. 1, showing the relection of light rays from the reflector surface.

Turning now to the drawings in which like reference characters indicate corresponding elements throughout the several views, attention is directed to FIGS. 1, 2 and 4, which show the floodlight according to the present invention, indicated in its entirety by the numeral 10. The floodlight 10 includes a generally rectangular housing 12 formed of a durable, lightweight material such as anodized aluminum. The housing 12 comprises a casting 13 having top and bottom walls 14, 16 integrally formed with a rear wall 18. A pair of opposed end walls 20, 22 are secured to the lateral edges of the casting 13. A tubular light emitting member 24, such as a standard halogen bulb, extends between the end walls 20 and 22. The light-emitting member 24 may also be referred to as a "light line".

The front edges of the casting 13 and end walls 20 and 22 all fall in a single plane, referred to as a light-emitting opening plane, which is generally oriented in a vertical direction. A front bezel 26 having a transparent cover 28 is removably coupled to the front edges of the casing 13 and end walls 20 and 22, protecting the light line 24 from dust and moisture, while at the same time providing easy access so that the bulb can be changed in a matter of seconds. A pivotable mount 30 secures the housing 12 to a telescoping pole 32. A handle 34 secured to the top wall 14 of the casing 13 provides a convenient grip for pulling the floodlight 10 along the pole 32.

FIG. 3 shows a typical emergency scene in which the floodlight 10 may be employed. The floodlight is mounted on a fire truck 35, with the telescoping pole 32 extended to a height of approximately 12' above the ground. The fire truck 35 is parked approximately 60' from a structure such as a building 36 which is approximately 30' tall. For purposes of description, the generally conical area defined by the floodlight 10, the bottom edge of the building 36, and the top edge 40 of the building 36 will herein be referred to as the "action area" 42 of the emergency scene, while the generally rectangular patch of ground 44 extending between the bottom edge 38 of the building 36 and a straight line (endpoint shown at 46) extending parallel to the bottom edge 38 of the building and passing almost directly below the floodlight 10 will be referred to as the "work area".

The distribution of light emitted from a conventional stadium-type floodlight is represented by the conical area defined by arrow α—α and lines 48 and 50 in FIG. 3. Arrow α—α represents a cone angle of approximately 140°. As can be seen from the illustration, a good portion of the light is directed above the action area 42, shining into the sky where it is essentially wasted. In addition, very little if any light is directed into the immediate vicinity of the truck 35 where personnel prepare their gear and tools.

In contrast, the distribution of light emitted by the floodlight 10 of the instant invention is represented by the hatch-marked areas extending between lines 52 and 53. Approximately 50% of the light is contained within the action area 42, while the other 50% is directed at the work area 44. Very little, if any, light is directed into the sky above the top edge 40 of the building 36, while ample light is directed to the area near the truck 35. In addition, illumination is generally constant over the entire emergency scene.

Figure 6:
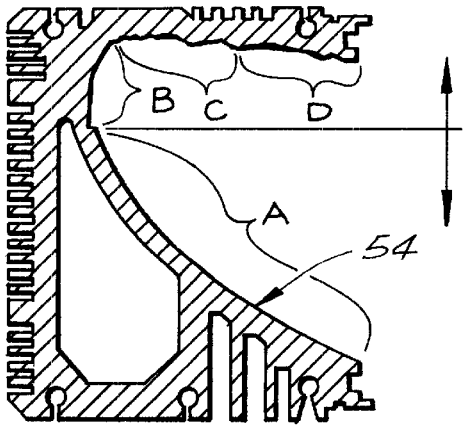
FIG. 6 is a sectional view similar to FIG. 5, showing the reflector surface with the light line removed for purposes of clarity.
Figure 9:
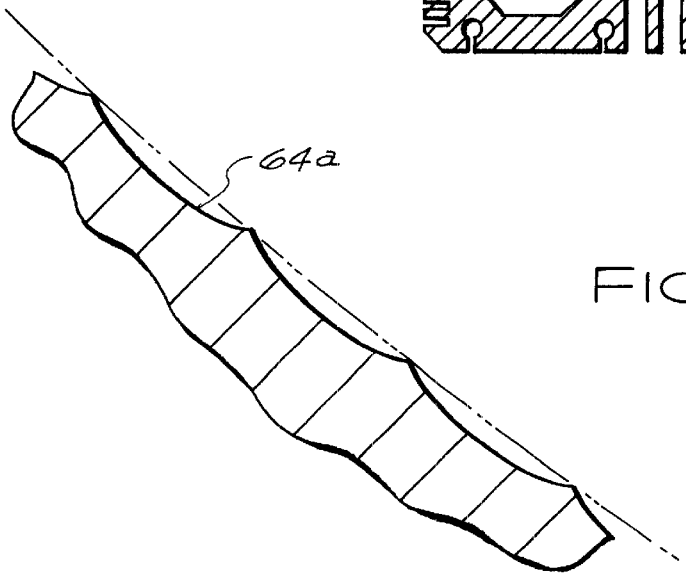
FIG. 9 is an enlarged detail showing the inner surface of portion A of the reflector surface shown in FIG. 8.

To produce the pattern of illumination described above, the interior of casting 13 has been configured using computer-aided design techniques to produce a customized reflector surface 54. Details of the reflector surface 54 are shown in FIGS. 5–10. For purposes of description, the reflector surface 54 is divided into four sections A, B, C, D as shown in FIG. 6.

Figure 8:
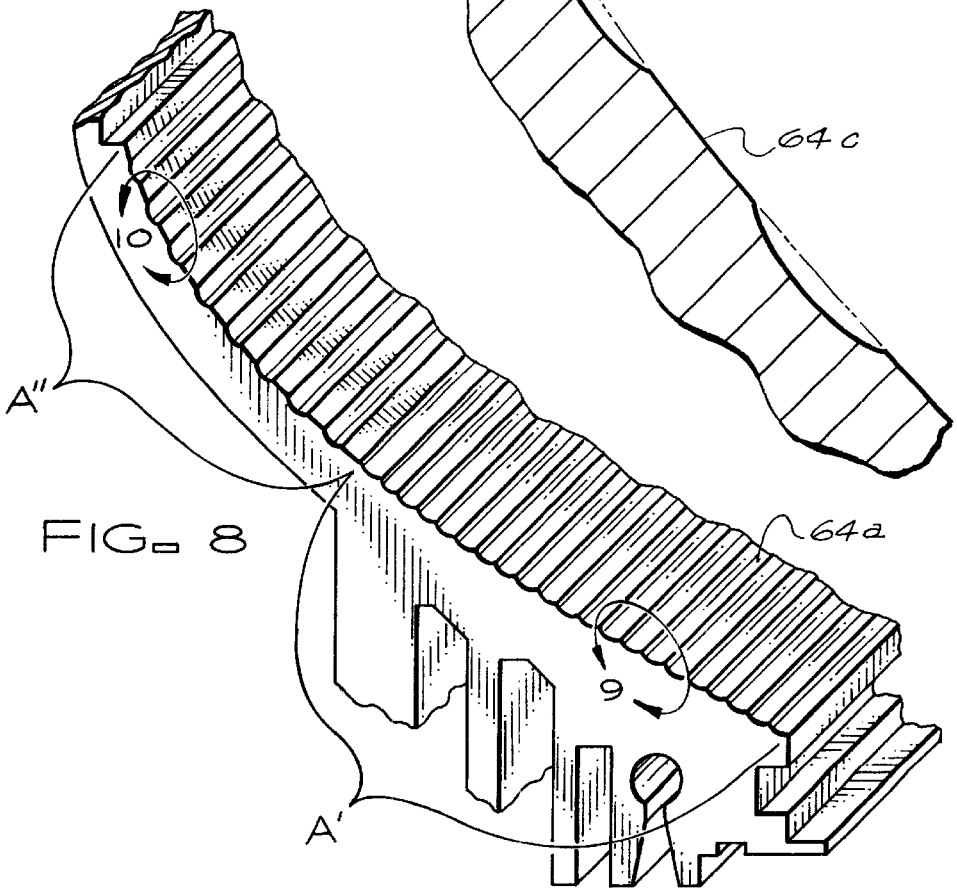
FIG. 8 is a perspective view showing the lower portion of the reflector section of FIG. 6.

Section A of the reflector surface 54, shown in greater detail in FIG. 8, is located below the light line 24 and is generally parabolic in section. Light rays from the light line 24 reflect off the surface of section A at an angle of about ±5° to ±10° from horizontal, as shown by ray 56 in FIG. 5. Rays from this section of the reflector surface 54 illuminate the action area 42 of the emergency scene.

Figure 7:
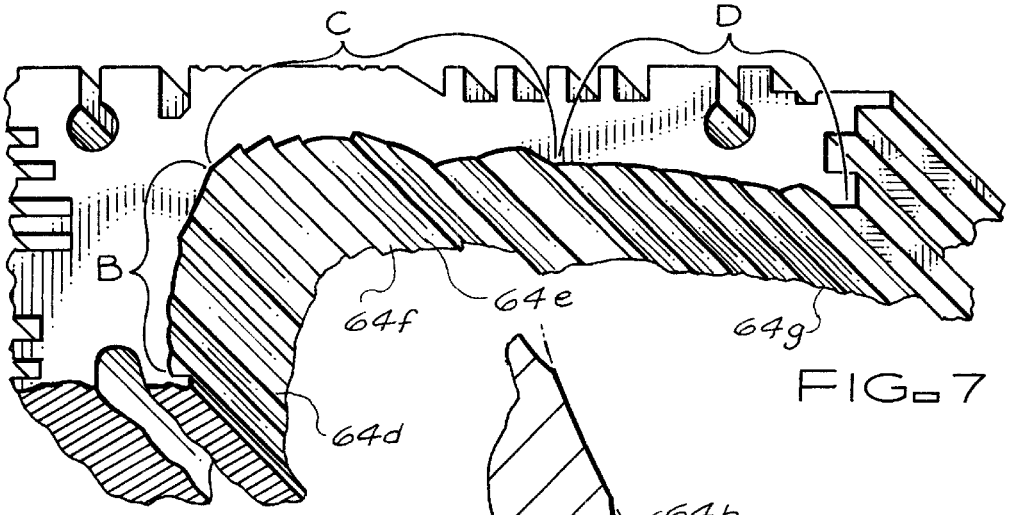
FIG. 7 is a perspective view showing the upper portion of the reflector section of FIG. 6.
Figure 10:
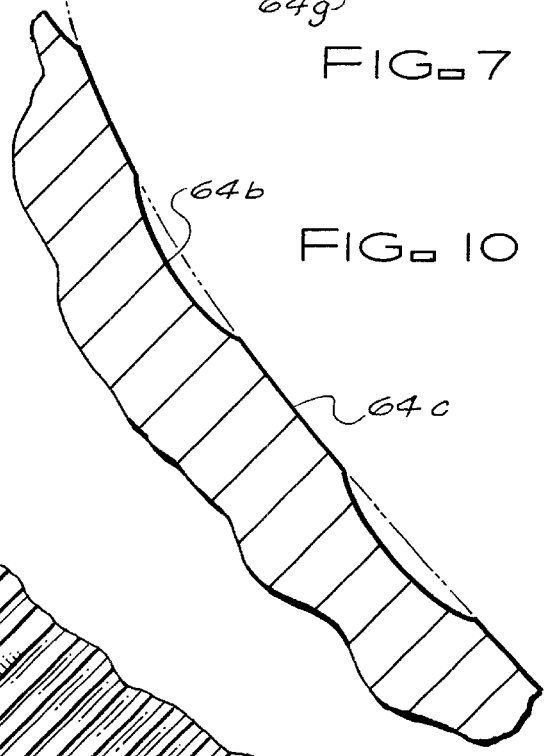
FIG. 10 is an enlarged detail showing the inner surface of portion A' of the reflector surface shown in FIG. 8.

Section B of the reflector surface 54, shown in greater detail in FIG. 7, is located behind the light line 24 and is also generally parabolic in section. The surface in section B is configured such that light rays from the light line 24 are reflected at an angle less than 45° below horizontal, as shown by ray 58 in FIG. 5. Rays from this section of the reflector surface 54 illuminate a front portion of the work area 44, near the bottom edge 38 of the building 36.

Section C of the reflector surface 54, shown most clearly in FIG. 7, is located above the light line 24 and is generally arcuate. The surface in section C is configured such that rays from the light line 24 are reflected toward section A, where they undergo a second reflection about 5° to 10° from horizontal, as shown by ray 60 in FIG. 5. Rays from this section of the reflector surface 54 illuminate the action area 42.

Section D of the reflector surface 54, also best seen in FIG. 7, is located above and in front of the light line 24, and is generally straight. The surface in section D is configured such that rays from the light line 24 are reflected generally downwardly, as shown by ray 62, toward a rear portion of the work area 44 extending from almost directly beneath the lamp 10 to almost the bottom 38 of the building 36.

Each of the sections A, B, C, D, of the reflector surface 54 comprises a multitude of individually aimed reflector elements 64, each of which has been specifically tailored to produce the desired distribution of light.

As shown in FIG. 8, the bottom section A of the reflector surface 54, is further divided into two portions A' and A". The reflector elements 64*a* of the front portion A' are all generally arcuate, as shown in exaggerated fashion in FIG. 9. The rear portion A" comprises an alternating series of arcuate reflector elements 64*b* and planar reflector elements 64*c*, as shown in. exaggerated fashion in FIG. 10.

The configuration of the remaining reflector elements can best be seen in FIG. 7. The reflector elements 64*d* in section B are generally arcuate as in section A'. Section C comprises a series of connected curved reflector elements. 64*e* and planar reflector elements 64*f*. Section D comprises a series of connected curved elements 64*g*. Each of these elements is individually designed with the object of emitting progressively more light flux as distance from the floodlight increases, so that illumination over the entire emergency scene is generally constant.

Various modifications and variations to the embodiment herein, chosen for purposes of illustration, will readily occur to those skilled in the art. To the extent that such variations and modifications do not depart from the spirit of the invention, they are intended to be included within the scope thereof which is assessed only by a fair interpretation of the following claims.

Having fully described and disclosed the instant invention and alternately preferred embodiments thereof in such clear and concise terms as to enable those skilled in the art to understand and practice the same, the invention claimed is:

What is claimed is:

1. A floodlight for illuminating an emergency scene, the emergency scene including a structure having a top, a bottom, a known height, and a known distance from the floodlight, a generally rectangular work area defined by a section of ground extending between the bottom of the structure and a line parallel to the bottom of the structure passing almost directly under the floodlight, and a generally conical action area defined by the floodlight, the top of the structure, and the bottom of the structure, the floodlight comprising:

a straight light line, a light-emitting opening plane forward of the light line, and a reflector surface configured to emit progressively more light flux as the distance from the light line increases, resulting in generally uniform illumination over the entire emergency scene.

2. A floodlight according to claim 1, wherein the reflector surface comprises:

a first, generally parabolic section located beneath the light line and configured to reflect rays from the light line in a path about ±5°–10° from horizontal to illuminate the action area of the emergency scene;

a second, generally parabolic section located behind the light line and configured to reflect rays of light from the light line in a direction less than 45° from horizontal to illuminate a front portion of the work area near the bottom of the structure;

a third, generally arcuate section located above the light line and configured to reflect rays from the light line toward the first section wherein the rays are again reflected in a generally horizontal direction to illuminate the action area; and a fourth, generally straight section located above and forward of the light line and configured to reflect rays from the light line in a generally downward direction to illuminate a rear portion of the work area extending from almost directly below the floodlight to almost the bottom of the structure.

3. A floodlight according to claim 2, wherein the individually aimed reflecting elements of the fourth section a comprise a series of connected curved elements.

4. A floodlight according to claim 2, wherein each of the first, second, third and fourth sections comprises a multitude of individually aimed reflecting elements.

5. A floodlight according to claim 4, wherein the first section includes a front portion wherein each of the individually aimed reflecting elements is generally arcuate; and a rear portion wherein the individually aimed reflecting elements comprise an alternating series of generally arcuate and generally flat elements.

6. A floodlight according to claim 4, wherein the individually aimed reflecting elements of the second section comprise a series of connected curved and flat elements.

7. A floodlight according to claim 4, wherein the individually aimed reflecting elements of the third section comprise a series of connected curved and flat elements.

8. A floodlight for illuminating an emergency scene, the emergency scene including a structure having a top edge, a bottom edge, a known height, and a known distance from the floodlight, a generally rectangular work area perpendicular to the structure and extending from the bottom edge of the structure to a line parallel to the bottom edge of the structure and passing almost directly under the floodlight, and a generally conical action area having the floodlight as a vortex and the structure as a base, the floodlight comprising:

a straight light line, a light-emitting opening plane forward of the light line, and a reflector surface configured to emit progressively more light flux as the distance from the light line increases, resulting in generally uniform illumination over the entire emergency scene, the reflector surface including a plurality of sections, each of the sections configured to reflect rays from the light line in a different direction from the rays reflected by the other sections.

9. A floodlight according to claim 8, wherein the sections comprise:

a first section configured to reflect rays from the light line in a direction generally perpendicular to the opening plane;

a second section configured to reflect rays of light from the light line in a direction less than 45° below horizontal;

a third section configured to reflect rays of light from the light line toward the first section, where the rays are reflected a second time; and a fourth section configured to reflect rays of light from the light line in a generally downward direction.

10. A floodlight according to claim 9, wherein the reflector surface further comprises a multitude of minute, individually aimed reflecting elements superimposed on each of the sections.

11. A floodlight for illuminating an emergency scene, the emergency scene including a structure having a top edge, a bottom edge, a known height, and a known distance from the floodlight, a generally rectangular work area perpendicular to the structure and extending from the bottom edge of the structure to a line parallel to the bottom edge of the structure and passing almost directly under the floodlight, and a generally conical action area having the floodlight as a vortex and the structure as a base, the floodlight comprising:

a straight light line, a light-emitting opening plane forward of the light line, and a reflector surface configured to direct approximately 50% of the light at the work area and keep 50% within the action area, resulting in generally uniform illumination over the entire emergency scene, the reflector surface including a plurality of sections, each of the sections configured to reflect rays from the light line in a different direction from the rays reflected by the other sections.

* * * * *